United States Patent [19]

Duret et al.

[11] Patent Number: 5,062,396

[45] Date of Patent: Nov. 5, 1991

[54] DEVICE AND METHOD FOR INTRODUCING A CARBURETTED MIXTURE UNDER PRESSSURE INTO THE CYLINDER OF AN ENGINE

[75] Inventors: Pierre Duret, rue du Conservatoire; Jean-Luc Blanchard, rue Henri Dunant, both of France

[73] Assignee: Institut Francais Du Petrole, Rueil-Malmaison, France

[21] Appl. No.: 461,487

[22] Filed: Nov. 9, 1989

Related U.S. Application Data

[63] Continuation of Ser. No. 210,912, Jun. 24, 1988, abandoned.

[30] Foreign Application Priority Data

Jun. 26, 1987 [FR] France ..... 87 09035

[51] Int. Cl.[5] ..... F02M 23/00

[52] U.S. Cl. ..... 123/73 BA; 123/298

[58] Field of Search ..... 123/73 R, 73 B, 73 BA, 123/73 PP, 298, 534

[56] References Cited

U.S. PATENT DOCUMENTS

| | | | |
|---|---|---|---|
| Re. 27,367 | 5/1972 | Von Seggern et al. | 123/73 BA |
| 1,237,312 | 8/1917 | Donning | 123/73 BA |
| 1,593,989 | 7/1926 | Rafter | 123/73 BA |
| 1,600,795 | 9/1926 | Cage | 123/73 BA |
| 1,986,674 | 1/1935 | Gernandt | 123/73 BA |
| 4,628,888 | 12/1986 | Duret | 123/534 |

*Primary Examiner*—Andrew M. Dolinar
*Assistant Examiner*—M. Macy
*Attorney, Agent, or Firm*—Antonelli, Terry, Stout & Kraus

[57] ABSTRACT

A method and device for introducing carburetted mixture under pressure into a first cylinder of an internal combustion engine comprising at least one other cylinder having a crankcase pump. The device for introducing carburetted mixture comprises a connecting duct between the crankcase and the first cylinder and an angular non zero shift exists between the cycle of each of the cylinders.

21 Claims, 5 Drawing Sheets

DEVICE AND METHOD FOR INTRODUCING A CARBURETTED MIXTURE UNDER PRESSSURE INTO THE CYLINDER OF AN ENGINE

This is a continuation of application Ser. No. 210,912, filed June 24, 1988 abandoned, Jan. 9, 1991.

BACKGROUND OF THE INVENTION

The present invention relates to a method and device for introducing, under pressure carburetted mixture into a cylinder of a Z-stroke engine at an end of an air scavenging, with the pressure source being the pressure existing in a crankcase of the cylinder which is retarded by 120° of the crankshaft (case of a 3, 6, . . . , 3n cylinders engine) or by the crankcase of the cylinder which is retarded by 90° of the crankshaft (case of a 4, 8, . . . , 4n cylinders engine) with respect to the considered cylinder where introduction of a carburetted mixture takes place. This pressure source is not stored.

The introduction of carburetted mixture under pressure takes place at the arrival of gas coming from the pressure source into the considered cylinder during the end of the scavenging phase thereof. The arrival of gas from this pressure source into a fuel metering device prepares a carburetted mixture which may be introduced into the cylinder through an orifice which may be located in the cylinder head and preferably be open solely during the intake of the pressure source.

In this case, the device may comprise a valve controlled so as to open during the arrival of gas coming from this pressure source, or an automatic valve (non-return valve type) whose opening is controlled by the pressure from the pressure source.

The orifice may also be located in the cylinder, and the opening thereof may be controlled by movement of the piston (case of a port) combined with a non-return device of valve type (or rotary cock).

For example, one embodiment of this type may join the crankcase of the cylinder retarded by 120° or 90° of the crankshaft to the considered cylinder via a transfer duct arriving on the side opposite the exhaust into the cylinder considered (duct generally called rear transfer duct).

To the extent that the location for metering the oxydent (upstream of the intake orifice opening into the cylinder) is not under a pressure greater than the ambient pressure for all the time outside the period of carburettor mixture introduction, such dosing may be provided by low pressure injector, but also by means of simple devices such, for example, as a carburetor of the type used in the intake of a two-stroke engine.

SUMMARY OF THE INVENTION

The present invention relates generally to a device for introducing a carburetted mixture under pressure into a first cylinder of an internal combustion engine comprising at least one other cylinder with a crankcase pump. The introducing device comprises a connecting duct between said crankcase pump and the first cylinder, with an angular non-zero shift existing between the cycles of each of the cylinders.

This angular shift may be 120° and the cycle of the first cylinder may precede the cycle of the other cylinder by 120°.

Similarly, this angular shift may be 90° and the cycle of the first cylinder may precede the cycle of the other cylinder by 90°.

The device of the invention applies particularly to engines having a number of cylinders a multiple of 3 or 4.

The duct may open into the first cylinder in the vicinity of the cylinder head of the engine.

Similarly, the duct may open into the first cylinder in the lateral wall of this cylinder substantially at the low part of this cylinder.

The device of the invention comprises a closure member placed between the duct and the first cylinder, substantially in the vicinity of this latter.

The closure member may be a valve controlled by a cam, or electromagnetically, or a rotary valve.

Similarly, the closure member may be automatic and adapted to act in the manner of a valve.

The duct may comprise a fuel introduction and control member.

This fuel introduction member may be a low pressure injector, and may comprise a venturi nozzle associated with said low pressure injector.

The fuel introduction device may be a carburettor.

Control of this carburettor may be coupled to a control which controls the amount of gas fed into the crankcase pump of the first cylinder.

The device of the invention may comprise a non-return element such as a valve between the carburettor and the duct.

Still within the scope of the present invention, the fuel introduction and control member may comprise a membrane pump actuated by the pressure pulses of a crankcase pump.

The output pipe of this membrane pump which connects the latter to the duct, may comprise a system for adjusting its flow section. This system may comprise a needle and control means taking into account the mean pressure of a casing.

The present invention also provides a method for introducing carbureted mixture under pressure into a first cylinder of an internal combustion engine comprising at least one other cylinder having a crankcase pump. This method is characterized in that the pressure of the gases contained in the crankcase pump are used as pressure source for injecting the carburetted mixture into the other cylinder.

When the present invention concerns a multicylinder engine in which each cylinder comprises a crankcase pump, each of the cylinders may be connected to a crankcase pump of another angularly retarded cylinder.

Thus, with a three-cylinder engine each having a crankcase pump, each cylinder may be connected to the crankcase pump of the cylinder which is retarded by 120° of the crankshaft.

According to the present invention, the connecting duct does not serve as storage capacity and a volume thereof may be relatively small.

BRIEF DESCRIPTION OF THE DRAWINGS

The invention will be better understood from the following description of embodiments thereof with reference to the accompanying drawings wherein.

DESCRIPTION OF THE PREFERRED EMBODIMENTS

Figure 1:
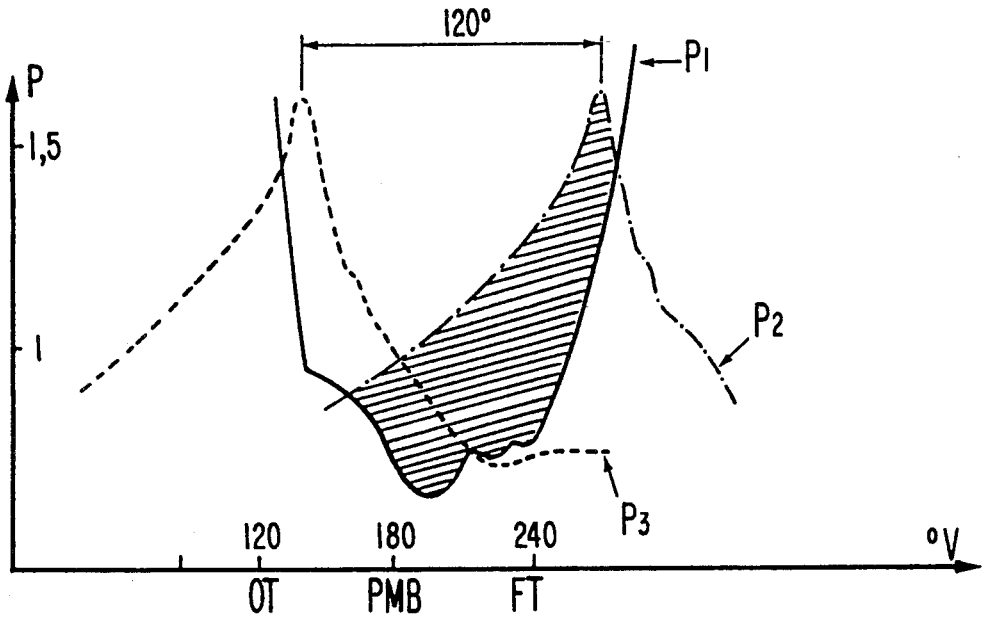
FIG. 1 is a graphical illustration of a principle of using the pressure existing in the crankcase of the cylinder retarded by 120° of a crankshaft of an engine with respect to the cylinder taken into consideration.

FIG. 1 shows with a continuous line bearing the reference P1, the curve of pressure variation in a considered cylinder during scavenging of the considered cylinder.

The pressure variation curve of the crankcase equipping this cylinder is shown with a broken line and bears the reference P3, and the variation of the pressure in the crankcase of the cylinder retarded by 120° is shown by a dash-dot line which bears the reference P2. This crankcase retarded by 120° with respect to the considered cylinder represents the pressure source. FIG. 1 clearly shows that the pressure of this source is greater than the pressure of the cylinder for a large part of the scavenging, corresponding to the hatched portion shown in FIG. 1.

This pressure source may then allow carburetted mixture to be introduced during the whole of this part of the operating cycle of the considered cylinder where the pressure difference is sufficient. By the choice and conception of the method of introduction adopted, controlled valve, automatic valve, port plus valve, or port plus rotary valve, it is possible to control to a greater or lesser degree the most favorable moment for feeding this carburetted mixture.

Figure 2:
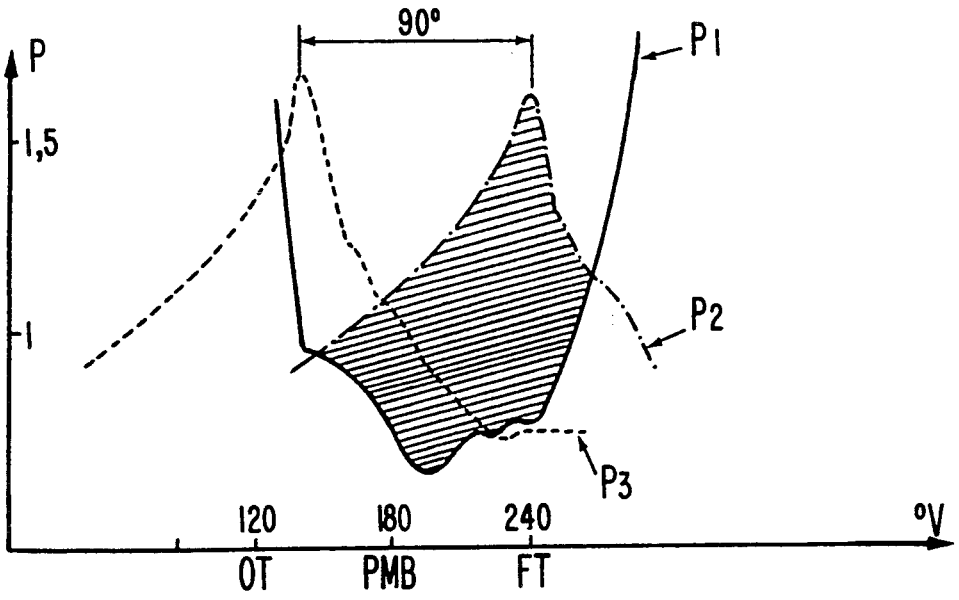
FIG. 2 is a graphical illustration of a retard by 90° of the crankshaft of the engine rather than 120° illustrated in FIG. 1.

FIG. 2 shows the same case, with this time a pressure source provided by a crankcase retarded by 90° of the crankshaft with respect to the cylinder considered, this corresponds more particularly to the case of an engine having 4 cylinders. The principle is the same, with, however, the pressure source available with a shift of 90° of the crankshaft arriving 30° of the crankshaft sooner than scavenging.

FIGS. 1 and 2 further show that during the whole of another large part of the cycle, the pressure in the considered cylinder (which is not however, shown over the whole cycle since its values would be outside the scale of the figures) is greater than the pressure of the pressure source. Now, it is important that there is no exchange in the direction of the considered cylinder towards the pressure source so as not to disturb the operation of the pressure source and of the fuel control device which is associated therewith.

In FIGS. 3, 5, 6, 7 and 10 the considered cylinder 1 is illustrated with an associated piston 2 thereof an end of scavenging, with an exhaust duct 3 and exhaust port 4 about to be closed. The cylinder 1 includes side 5 and rear 6 transfer ports, a crankcase 7 with an air intake only, for example through valves 8, a sparkplug 9, and a connecting rod-crank system 10.

FIGS. 3, 5, 6, and 10 also illustrate in dash-dot lines a cylinder 11 having a piston 12 whose movement is retarded angularly by 120° through the connecting rod-crank system 13, with respect to the piston 2 of considered cylinder 1. Piston 12 is in the expansion phase in cylinder 11 and at the same time in the compression phase in the crankcase pump 14.

The crankcase pump 14 in which the movement of piston 12 is retarded angularly by 120° supplies the pressure source through pipe 15.

Figure 4:
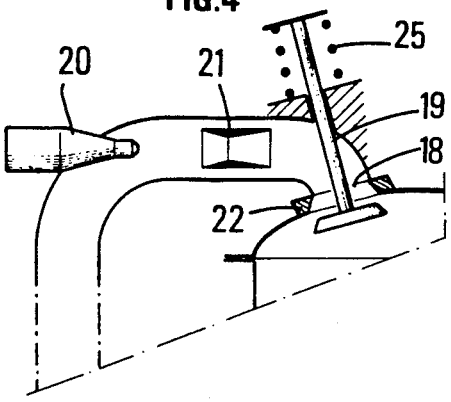
FIG. 4 is a partial cross-sectional view of a cylinder of an engine with an introduction, retarded by 120° of the crankshaft, of the carburetted mixture into the combustion chamber of the considered cylinder of the engine.
Figure 3:
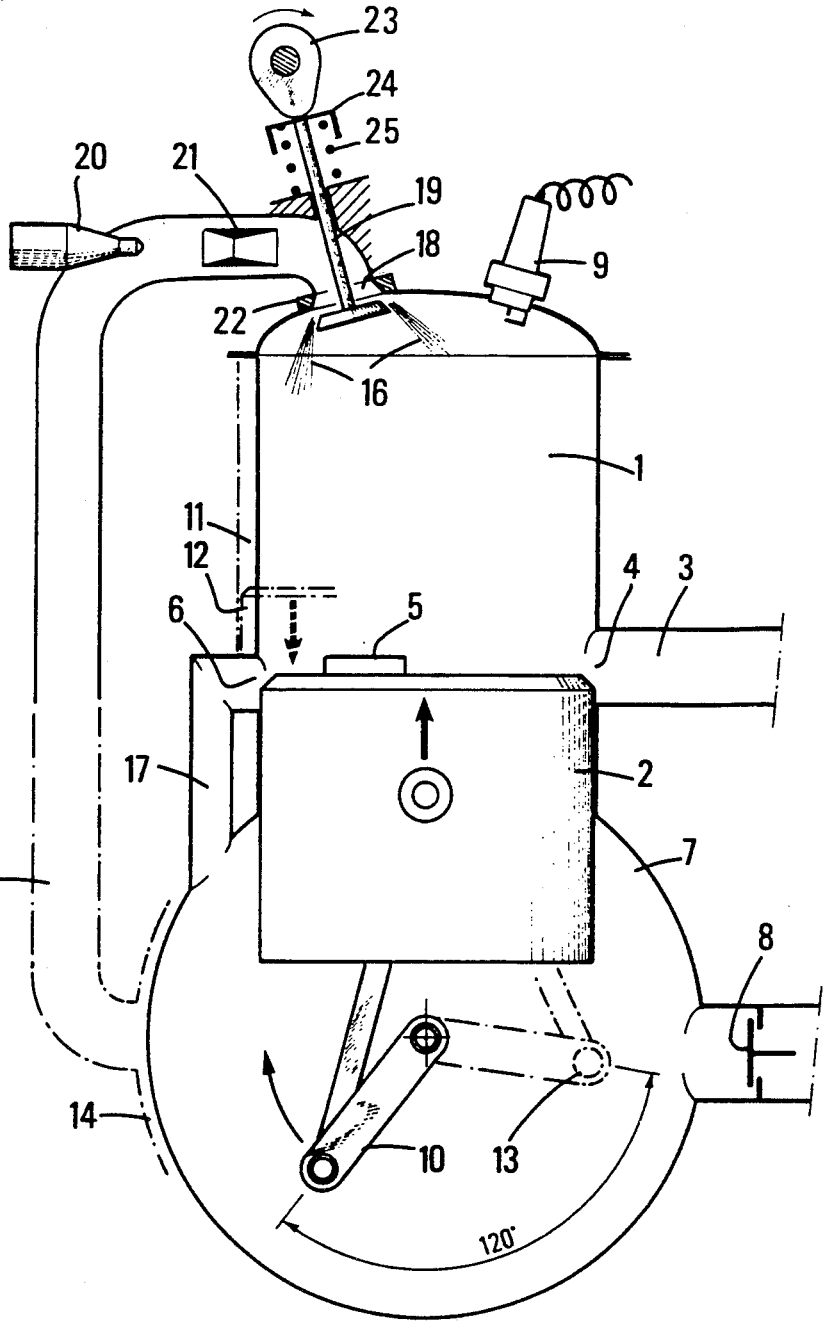
FIG. 3 is a partial cross-sectional schematic view of a cylinder of an engine with an introduction of carburetted mixture, delayed by 120° of the crankshaft of the engine, into the combustion chamber of the considered cylinder.

In FIGS. 3 and 4, the pipe 15 is connected to the combustion chamber 16 of the considered cylinder 1. The rear transfer 6 of cylinder 1 may then, if required, be connected to its own crankcase pump 7 through pipe 17.

The introduction of air under pressure from the crankcase pump 14 into chamber 16 takes place through an orifice 18 the opening of which is controlled by a valve 19. A fuel introduction control device 20 for the low pressure introduction and control of the fuel is provided upstream of the valve 19.

This device 20 may be a low-pressure injector which is commercially available, or a fuel pump, described more fully hereinbelow in connection with FIG. 8, actuated by the successive pressures and depressions of a crankcase pump. The liquid fuel may be introduced into pipe 15 not only during the whole time when valve 19 is closed but also when it is open.

This fuel introduction control device 20 may be associated with a venturi nozzle 21 placed in pipe 15, just upstream of valve 19 and orifice 18, as, for example, EP-189.714, so as to improve atomization of the fuel by the air coming from the pressure source (crankcase pump 14).

Just downstream of orifice 18, there may also be advantageously provided a deflector 22, or a device for orienting the jet of mixture introduced into the cylinder. This device forming part of the cylinder head or fixed to the cylinder head may, for example, to be of the type described in EP-189.715.

In the particular case of FIG. 3, the valve 19 is controlled mechanically, for example, by a cam 23 rotated at the speed of the engine. This cam 23 controls the movement of valve 19 through a pusher 24 with the valve 19 being returned by a spring 25.

In the particular case of FIG. 4 which illustrates another variant, valve 19 is not controlled but is simply equipped with a return spring 25. The valve 19 is left free to move as a function of the upstream and downstream pressure differences and thus acts in the manner of an automatic valve.

The valve may be controlled by an electromagnetic system which may be controlled electronically.

In FIGS. 3 and 4, when the pressure in the crankcase 14 is higher than the pressure in the considered cylinder 1 (FIG. 1), the carburetted mixture may be introduced into cylinder 1, either at the chosen controlled time (FIG. 3), or automatically during this period of pressure difference between crankcase 14 and cylinder 1 (FIG. 4). In both cases, movement of the piston 2 is such that it closes the exhaust port 4 before the fuel has been able to escape from cylinder 1 into exhaust duct 3 through the same port 4.

Figure 6:
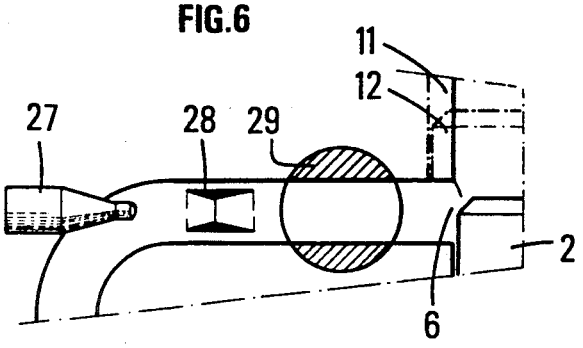
FIG. 6 is a partial cross-sectional view of a cylinder of an engine with an introduction, retarded by 120° of the crankshaft of the engine, of the carburetted mixture into a rear transfer of the considered cylinder of the engine via a rotary valve.
Figure 5:
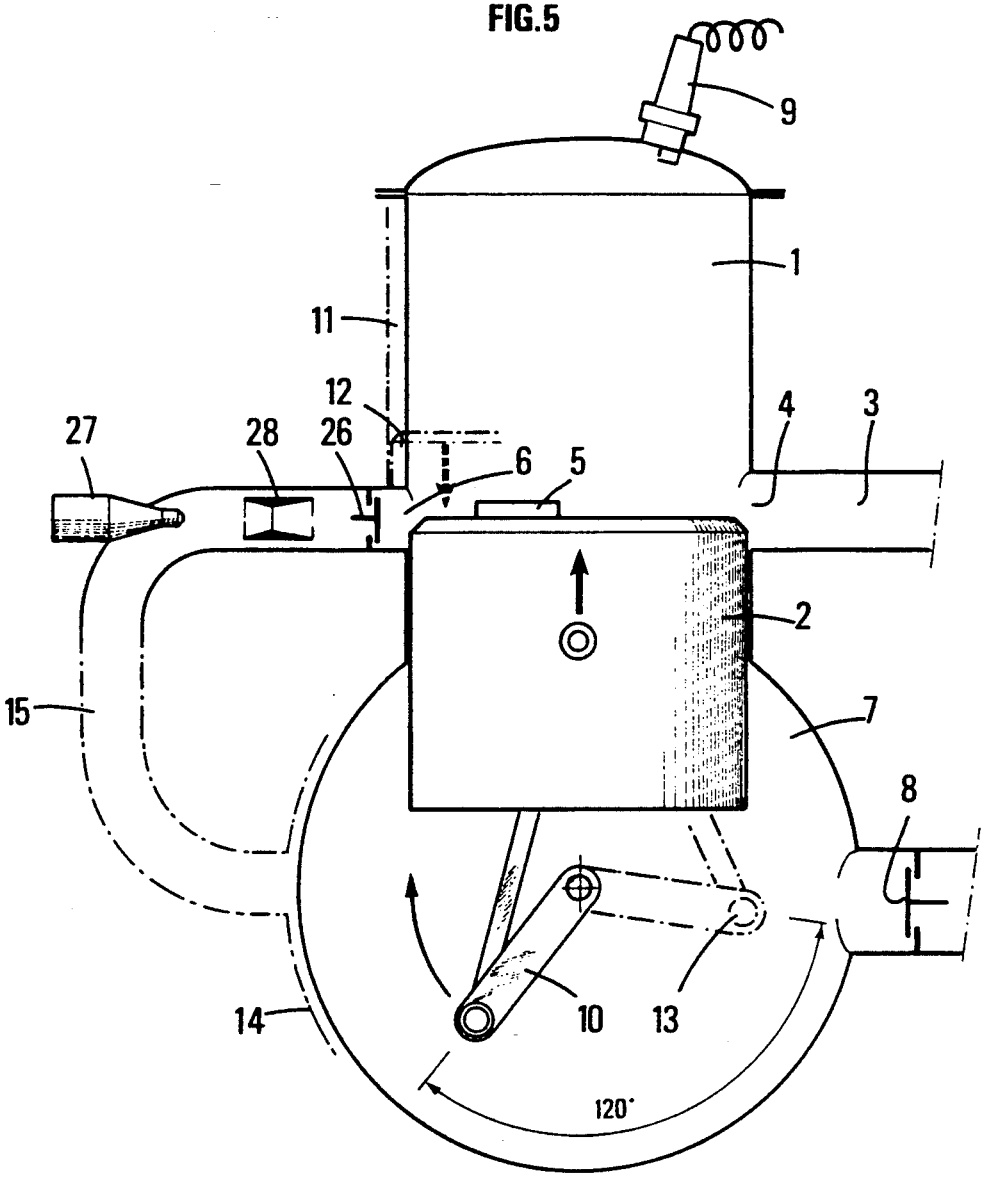
FIG. 5 is a partial cross-sectional view of a cylinder of an engine with an introduction, delayed by 120° of the crankshaft, of the carburetted mixture into a rear transfer of a considered cylinder of the engine via a non-return valve.

In FIGS. 5 and 6, the pipe 15 from a compressed air source 14 is connected to a transfer port, preferably to the rear transfer port 6, thus named because it is substantially opposite the exhaust port 4. In the vicinity of the port 6 and downstream therefrom, a non-return valve 26 prevents the gases from cylinder 1 from penetrating into the crankcase 14 during the depression phase of the latter.

Upstream of the valve 26 is located the low-pressure fuel introduction and control device 27. The fuel may be introduced at any moment of the cycle, even when port 6 is closed by piston 2.

Figure 10:
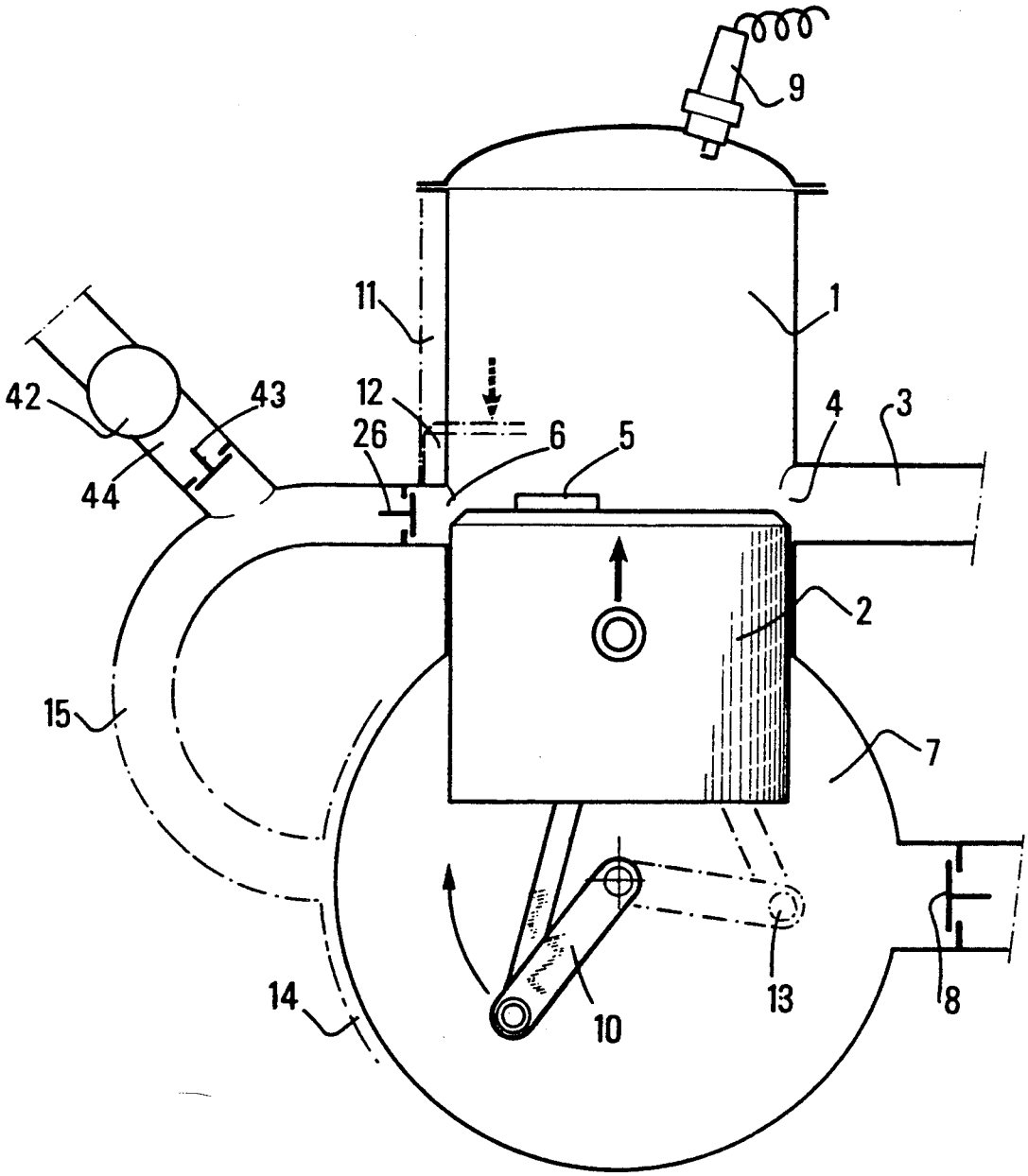
FIG. 10 is a schematic view of a cylinder of an engine with an introduction of carburetted mixture previously admitted by way of a conventional carburetor.

This fuel introduction control device 27 may be a low-pressure injector which is commercially available, or a fuel pump actuated by the successive pressures and depressions of the crankcase pump (FIG. 8), or a conventional carburetor actuated by the airflow therethrough. With a conventional carburetor, a second external air intake circuit should be provided, for example, through this carburetor and through pipe 15 as schematically shown in FIG. 10.

In all cases, atomization of the carburetted mixture may be advantageously improved by a venturi nozzle type device 28 placed just upstream of valve 26 of the type described, for example in patent FR-2.575.52.

In FIG. 6, the valve 26 is replaced by rotary valve 29 rotated by the engine and thus preferably controlling opening port 6.

Figure 7:
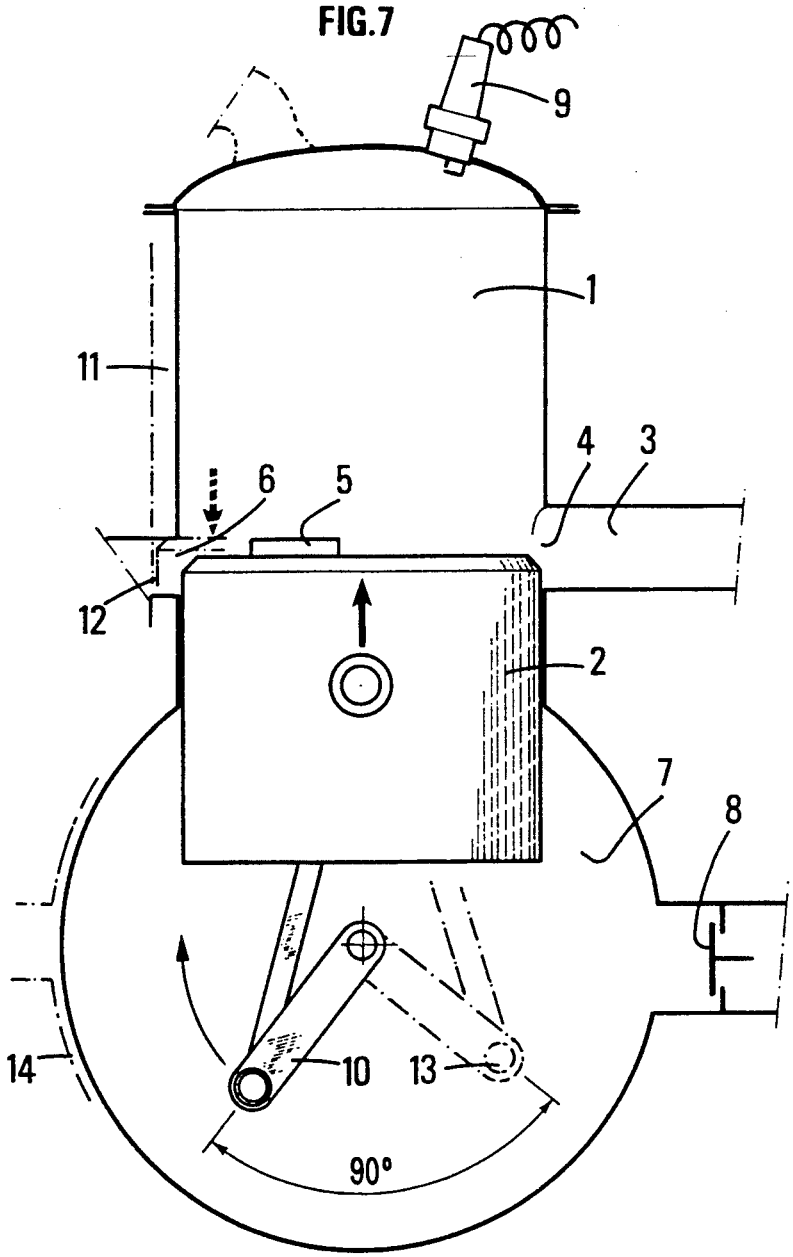
FIG. 7 is a partial cross-sectional view of a cylinder of an engine with an introduction, retarded by 90° of the crankshaft, of the carburetted mixture into the rear transfer of the considered cylinder.

FIG. 7 illustrates the case of FIG. 6 where the pressure source is provided by the movement in the crankcase pump 14 of a piston 12 retarded angularly by 90° of the crankshaft with respect to movement of the piston 2 of the considered cylinder 1. It is evident that the arrangements of FIGS. 3, 4, 5 could also be described in the same way with this retard of 90° of the crankshaft instead of 120°.

Figure 8:
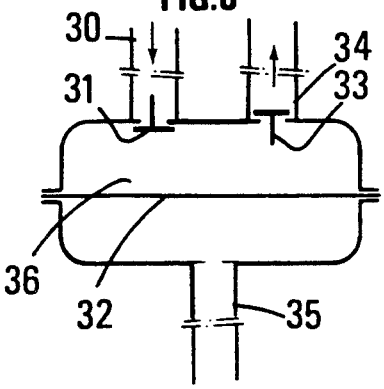
FIG. 8 is a schematic view of a device for controlling an introduction of the fuel by the pressure existing in the crankcase.

FIG. 8 shows a schematic representation of fuel control device which may be used in place of devices 20 or 27.

A control device schematically illustrated in FIG. 8 may be employed in place of the fuel introduction and control device 20 or 27 wherein the control device pumps the fuel from reservoir 30 via the non-return valve 31 as far as pipe 34 through the non-return valve 33. Membrane 32 serves as fuel pump. On one side it is in contact with the fuel which it pumps. On the other side, its reciprocating movement providing this pump role is actuated by the pressure pulses from a crankcase pump which may be either crankcase 7 or crankcase 14 and which is connected to this side of the membrane by pipe 35.

During the intake phase of the crankcase pump, the crankcase pump is under depression and therefore actuates membrane 32 so as to increase the volume 36 thus drawing in fuel through valve 31 which opens. Then during the compression phase of the crankcase, the movement of membrane 32 reduces the volume 36 and therefore pumps the fuel into pipe 34 via valve 33.

The control device of FIG. 8 serves for pumping and controlling the fuel and is coupled to the engine speed, since it provides one pumping movement per revolution, and it is also coupled to the load since amplitude of the pressure pulses in the crankcases is proportional to the load.

In a case where the control device of FIG. 8 is used alone, without the addition of finer control means, the pipe 34 is then connected directly to the position in pipe 15 where the fuel is introduced.

Figure 9:
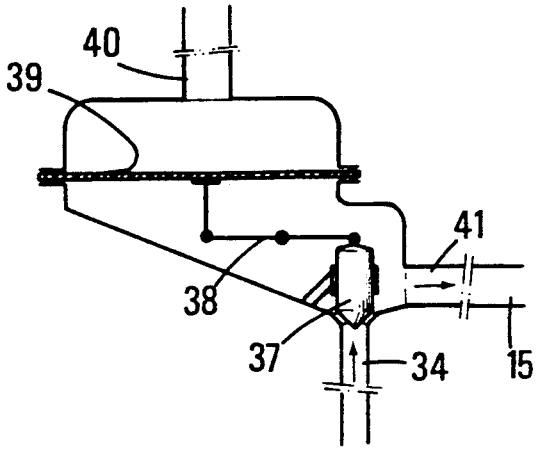
FIG. 9 is a schematic view similar to FIG. 8 of a control device for controlling an introduction of fuel by the pressure existing in the crankcase as a function of an engine load.

In the case where a finer adjustment of the fuel flow with respect to the load is required, the opening of pipe 34 is adjusted as a function of the load by a needle 37 which may be actuated either directly, or indirectly by a lever 38 connected to another membrane 39 as shown in FIG. 9. The other side of membrane 39 is here again in communication with the pressure of crankcase pump of the engine via a pipe 40.

The inertia of the assembly formed by needle 37, lever 38 and membrane 39 is chosen such that it does not allow movement of membrane 39 following the instantaneous pressure pulses of a crankcase. It must be designed so as to be controlled only by the mean pressure of a crankcase, which pressure is directly representative of the load of the engine. The result is a position of the control needle directly representative of the engine load. Near the needle, the fuel thus controlled is guided through pipe 41 as far as the position of introduction into pipe 15.

In FIG. 10, the pressure source of crankcase 14 through pipe 15 serves for introducing the carburetor mixture into cylinder 1, also serves during its depression phase for drawing in very rich carburetted mixture via conventional carburetor 42 and a valve type non-return device 43. The carburetor is for example a carburettor of conventional type for 2-stroke engines, with valve and needle correcting the nozzle opening of the jet with respect to the load.

The assembly forms a veritable second very rich mixture intake circuit, separate from the intake via the air valve 8 alone.

The length of pipe 15 may be designed so that the carburetted mixture thus admitted into this pipe does not reach the crankcase pump 14, before being driven into cylinder 1 by the pressure of the crankcase pump 14 which has returned to the compression phase.

Another very interesting advantage resides in the fact that, in the case of a multicylinder engine in which all the cylinders operate in accordance with the principle of the invention, with the adapted combinations of pipes 15, a single carburetor 42 may be used for all cylinders. Downstream of the carburetor 42, the different pipes 44 may separate for connection to the different cylinders, so as to be able to supply their respective pipes 15 with carburetor mixture through their respective valves 43.

The carburetor device of FIG. 10, a variant of the case shown in FIG. 5 may also be adapted to the case of FIGS. 3, 4 and 6.

In accordance with the present invention, pipe 15 which connects the crankcase pump 14 to the combustion chamber of cylinder 1, does not form a storage capacity but serves essentially for conveying the compressed gas in crankcase pump 14 to cylinder 1. Thus, it is important in accordance with the present invention for pipe 15 to have a sufficient flow section so as not to create excessive pressure losses of the transferred gas but to have a small volume so as not to limit the compression rate of the crankcase pump.

It should be noted that in accordance with the present invention it is useless for pipe 15 to be connected directly to an exhaust pipe. In accordance with the present invention, it is possible not to use the pressure of the exhaust gases for injecting the fuel.

Without departing from the scope of the present invention, the control of valve 19 may be pneumatic or hydraulic.

What is claimed is:

1. A device for introducing a carburetted mixture into a first engine cylinder of an internal combustion engine having at least one other engine cylinder with a crankcase pump, the device comprising a non-pressurized connecting duct disposed between said crankcase pump of said at least one other engine cylinder and the first engine cylinder and serving as a direct communication between said crankcase pump and said at least one other engine cylinder whereby the crankcase pump of said at least one other engine cylinder forms a sole pressure source for supplying necessary pressure through said connecting duct thereby enabling the introduction of the carburetted mixture under pressure into the first engine cylinder, and wherein an angular non-zero shift exists between cycles of said first engine cylinder and said at least one other engine cylinder.

2. The device as claimed in claim 1, wherein said angular shift is 120° and the cycle of the first engine cylinder precedes the cycle of the at least one other engine cylinder by 120°.

3. The device as claimed in claim 1, wherein said angular shift is 90° and the cycle of the first engine cylinder precedes the cycle of the other engine cylinder by 90°.

4. The device as claimed in claim 2, wherein said engine has a number of engine cylinders a multiple of 3.

5. The device as claimed in claim 4, wherein said engine comprises a number of engine cylinders a multiple of 4.

6. The device as claimed in claim 1, wherein said connecting duct opens into the first engine cylinder in a vicinity of a cylinder head of the engine.

7. The device as claimed in claim 1, wherein said connecting duct opens into the first engine cylinder in a lateral wall of the first engine cylinder, substantially at a lower portion of the first engine cylinder.

8. The device as claimed in claim 1, further comprising a closure member arranged between said connecting duct and said first engine cylinder, substantially in a vicinity of the first engine cylinder.

9. The device as claimed in claim 8, wherein said closure member is a valve controlled by a cam means.

10. The device as claimed in claim 8, wherein said closure member is an automatic pressure responsive valve.

11. The device as claimed in claim 8, wherein said closure member is a rotary valve.

12. The device as claimed in claim 1, further comprising a fuel introduction and control member arranged in said duct.

13. The device as claimed in claim 12, wherein said fuel introduction and control member includes a low pressure injector.

14. The device as claimed in claim 13, further comprising a venturi nozzle associated with said low pressure injector.

15. The device as claimed in claim 12, wherein the fuel introduction and control member includes a carburetor.

16. The device as claimed in claim 15, wherein a control of said carburetor is coupled with a control for controlling an amount of gas introduced into the crankcase pump of said first engine cylinder.

17. The device as claimed in claim 15, further comprising a non-return element arranged between the carburetor and said connecting duct.

18. The device as claimed in claim 12, wherein said fuel introduction and control member comprises a membrane pump actuated by pressure pulses of the crankcase pump.

19. The device as claimed in claim 18, wherein an output pipe of said membrane pump connecting the membrane pump to said connecting duct comprises means for adjusting a flow section of said duct including a needle and control means responsive to a mean pressure of the crankcase.

20. The device as claimed in claim 8, wherein said closure member is a valve controlled by an electromagnet.

21. The device as claimed in claim 15, wherein said non-return element is a valve.

* * * * *